US008439118B2

(12) United States Patent
Myerley et al.

(10) Patent No.: US 8,439,118 B2
(45) Date of Patent: May 14, 2013

(54) PRESSURE VORTEX DEVICE TO ALLOW FLAPPER CLOSURE IN HIGH VELOCITY FLUID APPLICATIONS

(75) Inventors: Thomas S. Myerley, Broken Arrow, OK (US); Tyler C. Roberts, Skiatook, OK (US); Grant R. Thompson, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 364 days.

(21) Appl. No.: 12/845,510

(22) Filed: Jul. 28, 2010

(65) Prior Publication Data

US 2012/0024532 A1 Feb. 2, 2012

(51) Int. Cl.
*E21B 34/06* (2006.01)
*F16K 15/03* (2006.01)

(52) U.S. Cl.
USPC ..... 166/332.8; 251/303; 137/527

(58) Field of Classification Search ..... 166/386, 166/332.8, 373; 137/527; 251/303
See application file for complete search history.

(56) References Cited

U.S. PATENT DOCUMENTS

| | | | | |
|---|---|---|---|---|
| 1,871,536 | A * | 8/1932 | Le Bus | 137/515 |
| 3,066,693 | A * | 12/1962 | Taylor, Jr. | 137/454.2 |
| 3,726,341 | A * | 4/1973 | Holbert, Jr. | 166/321 |
| 4,095,615 | A | 6/1978 | Ramsauer | |
| 4,674,575 | A * | 6/1987 | Guess | 166/332.8 |
| 5,201,371 | A * | 4/1993 | Allen | 166/325 |
| 6,227,299 | B1 | 5/2001 | Dennistoun | |
| 7,270,191 | B2 | 9/2007 | Drummond et al. | |
| 7,448,219 | B2 | 11/2008 | Bowers et al. | |
| 7,604,056 | B2 | 10/2009 | Haynes | |
| 7,644,732 | B2 | 1/2010 | Peric et al. | |
| 2006/0162939 | A1 | 7/2006 | Vick et al. | |
| 2009/0032238 | A1 | 2/2009 | Rogers et al. | |
| 2009/0151924 | A1 | 6/2009 | Lake | |

* cited by examiner

*Primary Examiner* — Kenneth L Thompson
(74) *Attorney, Agent, or Firm* — Steve Rosenblatt

(57) ABSTRACT

The problem of flappers that will not close due to high velocity gas rushing past and creating a vortex that has zones of high pressure pressing the flapper against the force of the torsion spring is reduced or overcome with modifications in the passage through a subsurface safety valve so as to reduce the intensity of the vortex to allow the torsion spring to pivot the flapper to closed position. Various shapes are inserted adjacent the flapper base to create turbulence to minimize or prevent the vortex and the associated pressure increases that would otherwise prevent flapper closure with the flow tube retracted. Inserts that create turbulence are placed in a recess that in part holds the flapper when it is rotated to the open position.

17 Claims, 6 Drawing Sheets

PRESSURE VORTEX DEVICE TO ALLOW FLAPPER CLOSURE IN HIGH VELOCITY FLUID APPLICATIONS

FIELD OF THE INVENTION

The field of the invention is subterranean safety valves of the flapper type and more particularly vortex control features that allow the flapper to close in high velocity fluid flow applications.

BACKGROUND OF THE INVENTION

Subsurface safety valves generally have a flapper that is closed by a torsion spring that is mounted on a pivot pin for the flapper. A hydraulic control system actuates a piston to move a flow tube in the valve passage against the flapper to hold it open. If pressure in the hydraulic system is removed or lost, the closure spring acts on the flow tube to lift it away from the flapper that until that time had been behind the flow tube in a recess in the housing. Once the flow tube moves up the torsion spring in the flapper pivot shaft would do the work of starting rotational movement of the flapper toward its conforming seat. When the flapper contacted the seat the pressure of the fluid below kept the flapper in that closed position sealed against the flapper seat. Pressurizing the control system again brought the flow tube against the closed flapper and made it pivot off the seat back to the open position.

As safety valves were made with larger flow bores and dealt with higher velocities particularly in gas service transient vortexes were formed of high pressure zones that changed location depending on the velocity. At certain flow passage dimensions and flow velocities these high pressure zones occurred in front of an open flapper to create a sufficient hold open force that the torsion spring was unable to move the flapper to the closed position even after the flow tube was raised to allow such flapper movement.

In the past, in addressing the larger sized flapper safety valves and the limitations of the torsion spring to move an ever heavier flapper, designs were developed along the lines of providing an assist to the torsion spring to start the flapper moving toward the closed position when the flow tube was raised up. U.S. Pat. No. 6,227,299 used a leaf spring 122 located behind the flapper 86 to add a closing force. US Publication 2009/0151924 uses a shape memory alloy closure spring to get a boost in the flapper closing force. Going in the opposite direction, U.S. Pat. No. 7,703,532 holds the flapper open with movably mounted magnets and U.S. Pat. No. 7,270,191 provides a mechanism to open the flapper when it will not go from the closed to the open position with the hydraulic system. US Publication 2009/0032238 uses repelling magnets in the housing and the flapper to give an assist to a torsion spring on the flapper pivot pin. U.S. Pat. No. 7,448,219 is a hingeless flapper design that shapes the flapper to be aerodynamic so that it can operate responsive to the flow passing by in an automotive application. U.S. Pat. No. 7,644,732 uses a bypass technique for dealing with pressure surges in a lubrication system when the circulating oil is still cold.

The various solutions discussed above have in common a focus on adding a closing force when it is time for the flapper to go to the closed position. The present invention addresses the configuration of the flow passage to reduce or eliminate the effect of flow induced pressure transients that can overcome the ability of the flapper torsion spring to close it in high velocity fluid flow situations in the order of 300 feet per second or higher. Rather than adding to the mechanical closing force applied to the flapper, the present invention focuses on dissipation of flow induced moving pressure gradients that can act on the flapper at the time it needs to close and reducing their affects by shaping the profile of the flow passage in the vicinity of the flapper or the flapper itself so that the localized pressure differentials are not large enough to overcome the torsion spring trying to close the flapper. Those and other aspects of the present invention will become more apparent to those skilled in the art from a review of the description of the preferred embodiment and the associated drawings while recognizing that the full scope of the invention is provided by the appended claims.

SUMMARY OF THE INVENTION

The problem of flappers that will not close due to high velocity gas rushing past and creating a vortex that has zones of high pressure pressing the flapper against the force of the torsion spring is reduced or overcome with modifications in the passage through a subsurface safety valve so as to reduce the intensity of the vortex to allow the torsion spring to pivot the flapper to closed position. Various shapes are inserted adjacent the flapper base to create turbulence to minimize or prevent the vortex and the associated pressure increases that would otherwise prevent flapper closure with the flow tube retracted. Inserts that create turbulence are placed in a recess that in part holds the flapper when it is rotated to the open position. Additionally and alternatively the flapper itself can be machined so as to create a larger annular space behind the flapper when it is open so that some part of the generated vortex can be used to push the flapper to the closed position and to offset the high pressure zones created on the other side of the open flapper.

DETAILED DESCRIPTION OF THE PREFERRED EMBODIMENT

Figure 1:
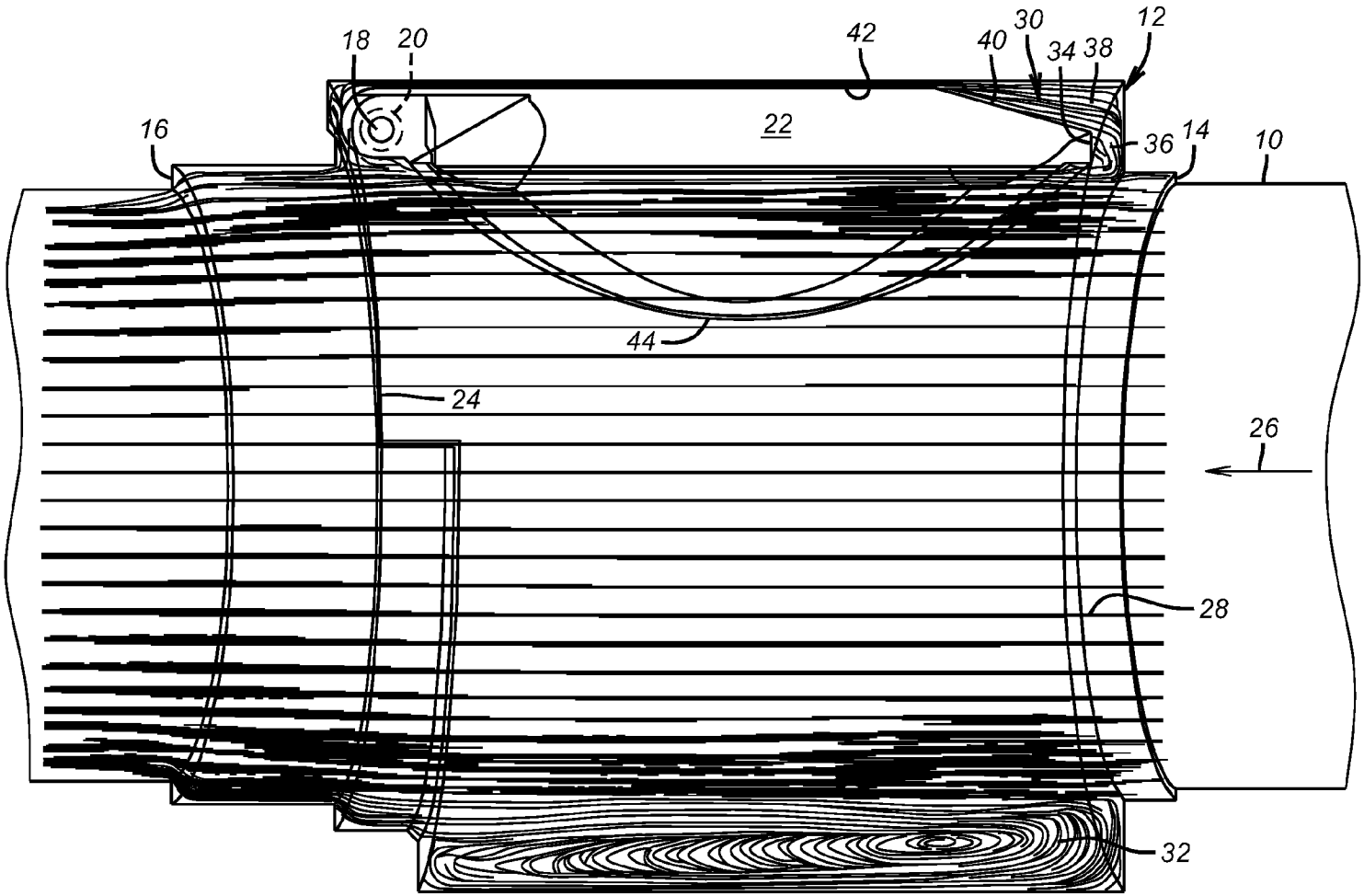
(PRIOR ART) FIG. 1
FIG. 1 is a prior art view of a flapper in the open position even after the flow tube moves uphole and flow passing through the passage that holds the flapper open due to a vortex causing high pressure.

As an introduction to the issue addressed by the invention FIG. 1 illustrates a tubular string 10 that has a safety valve housing 12 secured to the string 10 at opposite ends 14 and 16. In the position of FIG. 1 the flow tube (not shown) has already been raised by a control system (not shown). Normally, the raising of the flow tube allows a torsion spring 20 about a pivot shaft 18 to apply its stored potential energy force and rotate the flapper 22 toward a schematically illustrated seat 24. All the components of the housing 12 are not shown to add clarity to the identification of the issue using FIG. 1. Arrow 26 represents the incoming high velocity stream that is most likely to be gaseous and in the order of about 300 feet per second or higher to cause the problem. Flow lines 28 graphically illustrate how most of the flow goes straight through the housing 12 in a direction toward the surface. However, depending on the velocity and the composition of the passing fluid some of the flow begins to ebb into the recess 30 and create a vortex 32 generally that begins away from the location of the flapper 22 and works its way around the housing 12 in the recess 30. The vortex creates a high pressure concentration that is shiftable with the velocity that passes through the housing 12. In the beginning as the velocity picks up the vortex 32 is located near the lower end 34 of the flapper 22. At that location, the vortex 32 can actually be an aid to closure of the flapper 22 as it can pass through the gap 36 between the inside of the recess 30 and the housing 12. Once reaching the small annular space 38 defined by the tapered surface 40 on flapper 22 and the housing 12, the presence of the higher pressure at location 38 helps push the flapper away from wall 42. However as the velocity increases and the center of the higher pressure vortex 32 moves closer to the surface and toward the pivot shaft 18 the moment balance shifts and there is an ever greater moment acting on the top side 44 of the flapper that can be easily in excess of the closing moment applied by the torsion spring 20 as aided by what remaining portions of the vortex 32 still in the vicinity of the gap 36.

Figure 2A:
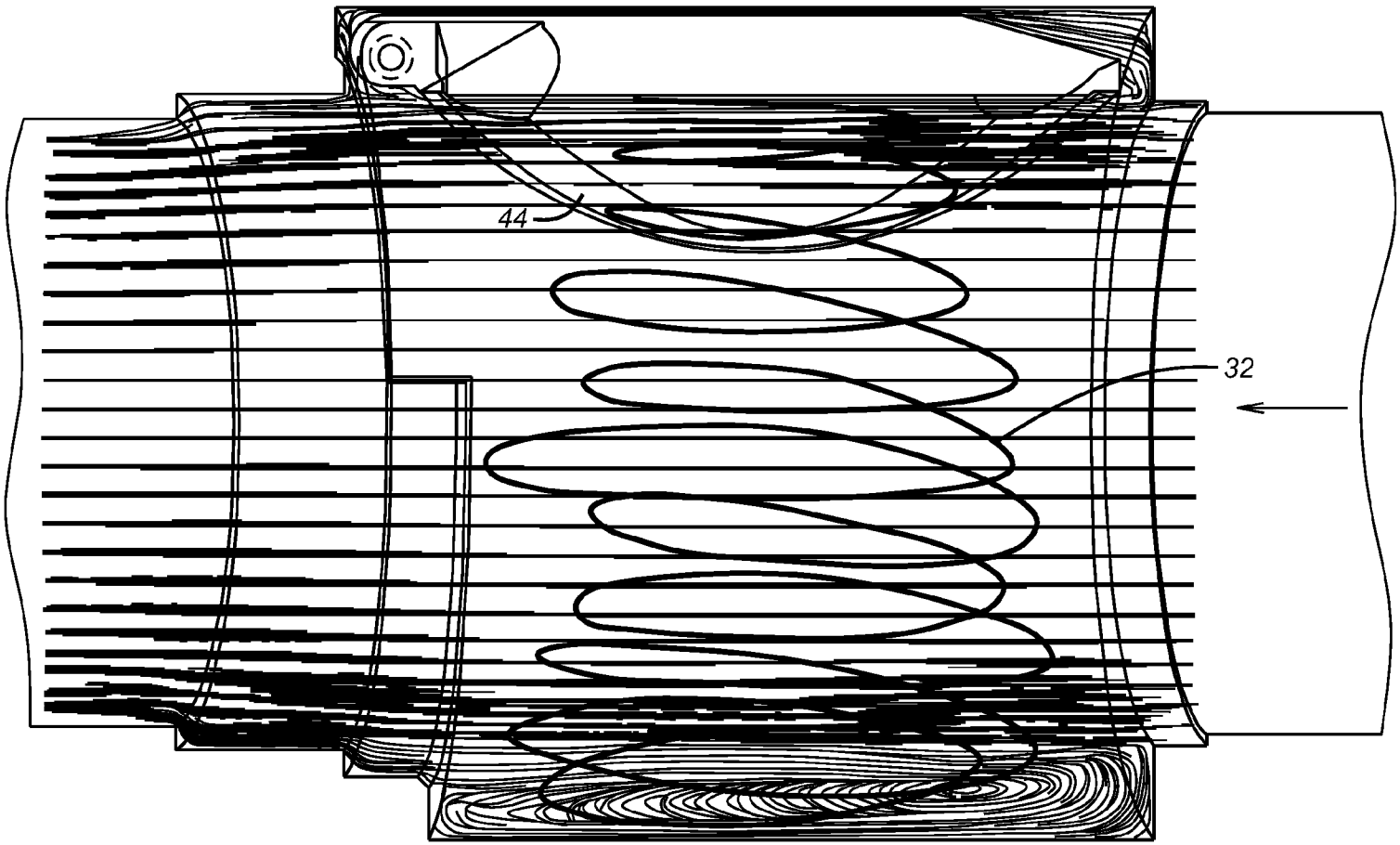
(PRIOR ART) FIG. 2A
FIG. 2A schematically shows the vortex against the flapper to hold it open in the prior art.
Figure 2B:
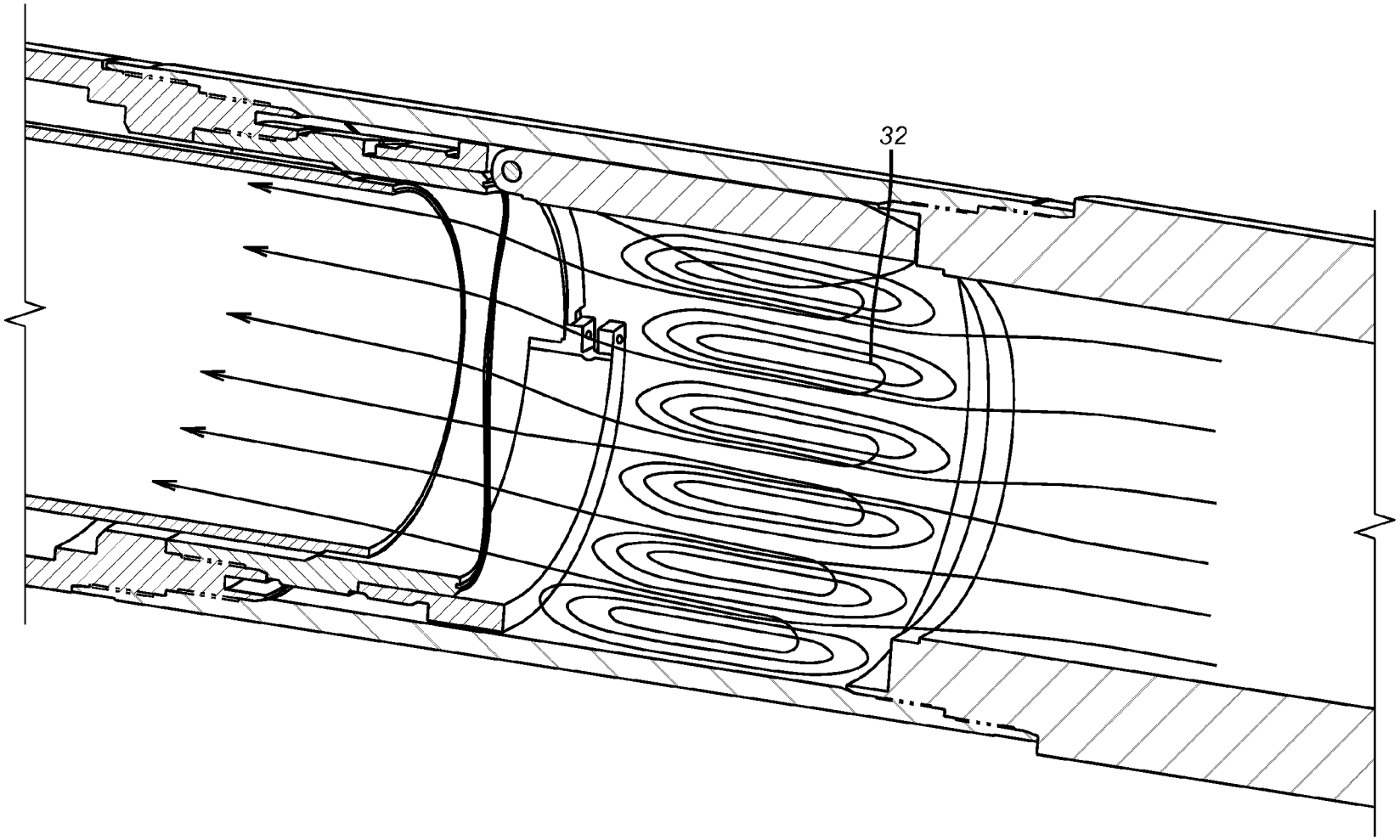
(PRIOR ART) FIG. 2B
FIG. 2B illustrates the vortex shown in FIG. 2A and the high velocity flow passing straight through as the flapper is held open in the prior art.

FIG. 2A adds to the schematic representation of how the vortex 32 works its way circumferentially to the top surface 44 of the flapper 22. FIG. 2B is the same illustration as FIG. 2A but showing a different viewing angle for more of a perspective view. Should the velocity at the time the flow tube is raised in an effort to have the torsion spring 20 rotate the flapper 22 to a closed position against its seat 24, the result can be that there is no flapper 22 movement at all. This can defeat the operation of the safety valve and can cause a blowout that would otherwise be prevented by the proper operation of the safety valve.

Figure 3:
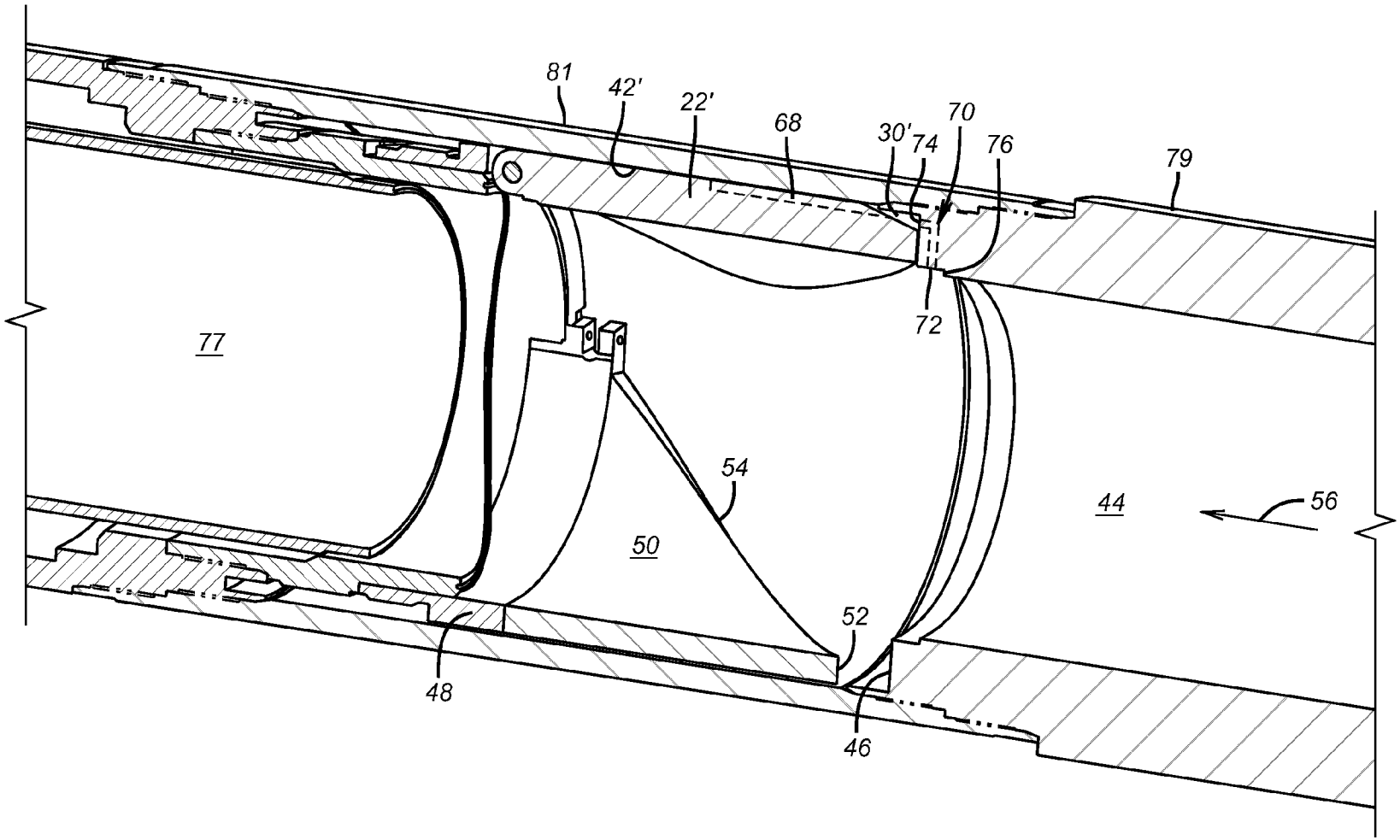
FIG. 3 shows one form of a device to reduce the pressure in the vortex using a partial sleeve that comes to a point directed at the incoming flow and has opposed sides sloping away from the leading point.
Figure 4:
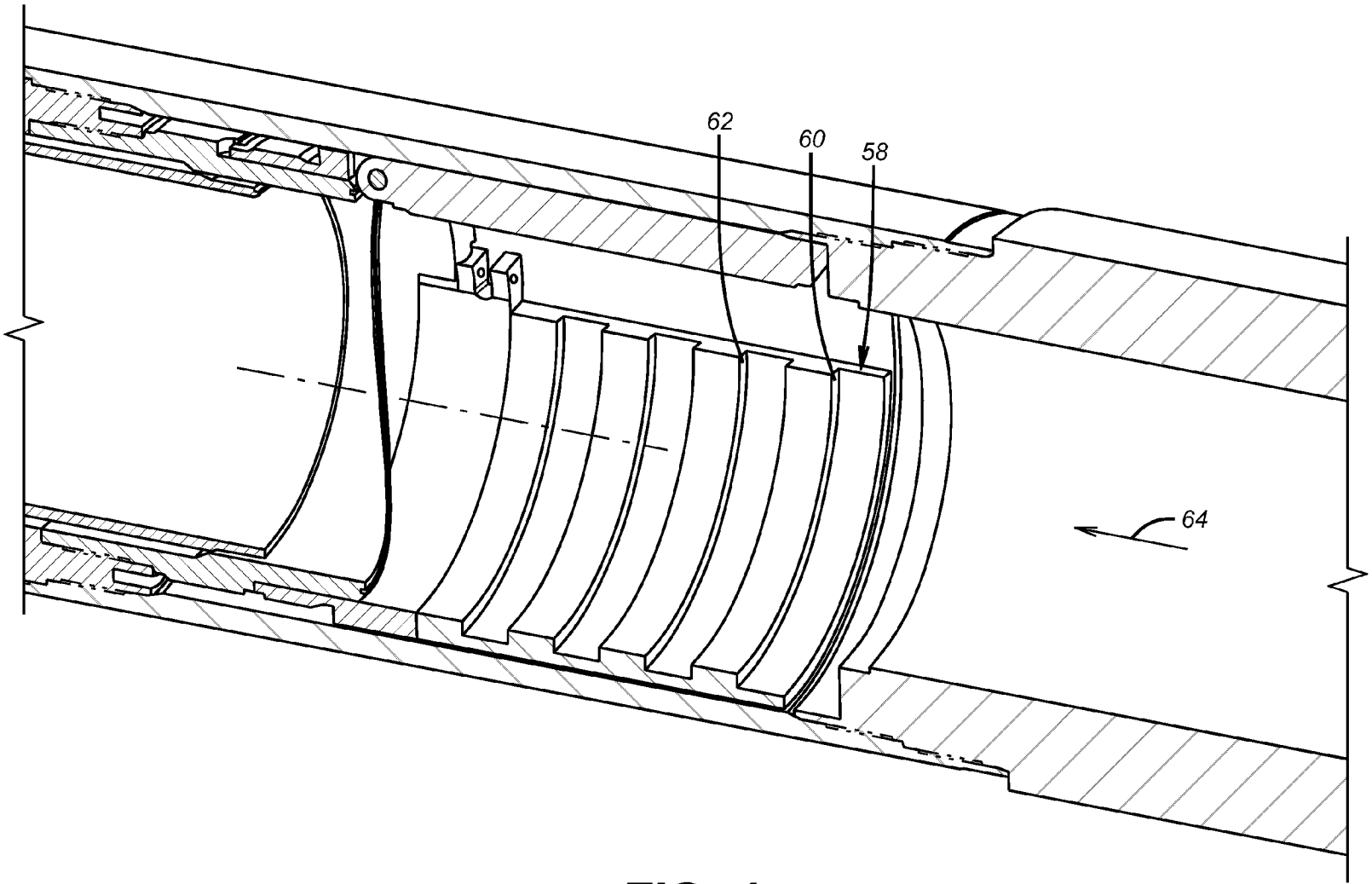
FIG. 4 puts an insert in the groove where the flapper is located when it is open showing a series of transverse ridges.
Figure 5:
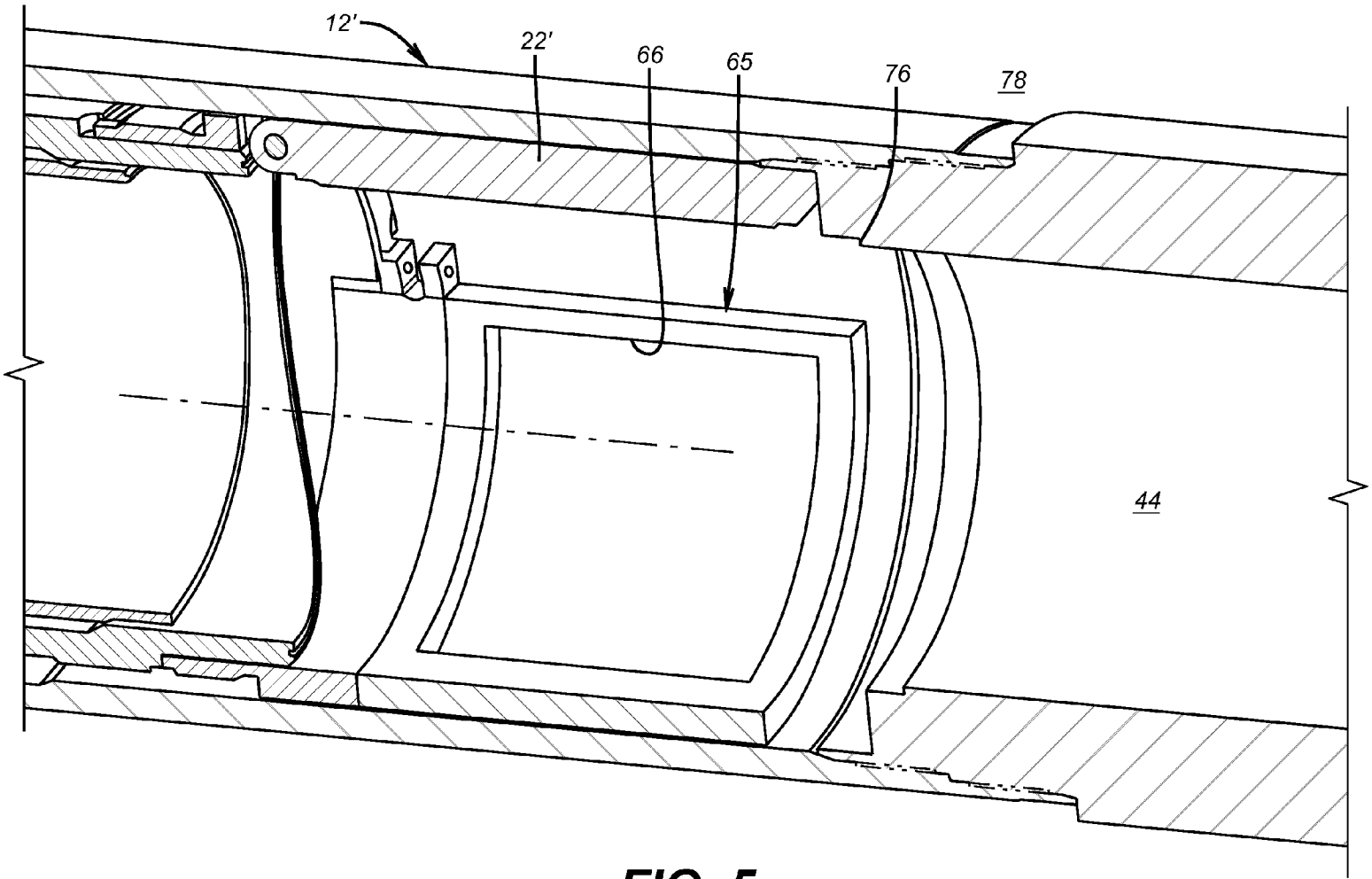
FIG. 5 shows an insert member in the groove where the flapper is located in the open position where the insert has an internal open space.

There are several ways that this situation can be addressed and three variations are illustrated in FIGS. 3-5 as preferred without any intent on limiting the variety of the approaches that look to reconfigure the internal passage in the housing 12 or the relation of the passage 44 to the flapper 22 or/and shaping of the flapper so that the vortex 32 is minimized in its intensity to the point where the torsion spring 20 can close the flapper 22' as needed or in the ideal case prevent the vortex 32 from forming at all. In FIG. 3 the shoulder 46 and the flapper base 48 define the recess 30' between them. Since the view in FIG. 3 is in section, only one half of the insert 50 is illustrated. The balance of the insert 50 that is not shown is preferably the mirror image of what is depicted. As a result the shape forms a downhole oriented point that can be sharp or blunt 52 from which opposed sides 54 extend and diverge in a direction toward the surface. The flow direction is given by arrow 56. The thickness of the insert 50 as well as its shape can be optimized using Computational Flow Dynamics software that can create a three dimensional model of the flow regime through the passage 44. Thus the height of the insert 50 can be varied to be taller, shorter or about the same height as the shoulder 46 that defines the recess 30'.

In a variation of the FIG. 3 design the insert 50 can be shaped to be a cylindrical member that fills partially to totally that portion of the recess 30' that continues beyond the sides of the flapper 22' so that in essence the circumferential extent of the recess 30' is somewhat wider that the width of the flapper 22' and that is it. Alternatively the flapper base 48 can be extended to accomplish the same result in a one piece rather than a two piece construction.

Another option is shown in FIG. 4 where the insert 58 is similarly positioned as in FIG. 3 and this time has a series of ridges such as 60 and 62 that are transverse to the direction of flow 64 that would otherwise cause the vortex 32 to form. The number and height and orientation of the ridges can also be optimized for the expected flow velocities. There can be ridge combinations that are transverse as shown in FIG. 4 combined with some ridges that are closer to parallel to the flow direction. A surface roughening on the face of the insert that faces the passage 44 is another alternative to control the vortex 32'.

Another approach is seen in FIG. 5 where the insert 65 has a void 66 that in the FIG. 5 is illustrated as square. Here again as in FIGS. 3 and 4 what is shown is a part of the insert 64 without the mirror image of it that is not in the illustration. Here again the void shape can be varied and optimized by mathematical modeling. There are other options for vortex control that can be implemented. For one the width of the gap 36 can be varied. Another approach is to increase the volume of the space behind the flapper and the surrounding housing. One example is to machine grooves on the back side of the flapper that faces the wall 42' such as schematically illustrated by the dashed line 68. There is a limit to the extent that the grooves on the back of the flapper can be used especially in the larger sizes as the flapper has to take large pressure differentials when closed and adding grooves can promote flapper distortion under maximum working pressure differentials to the point where leakage can occur. The idea on the back of the flapper is to create empty space behind the flapper to enable the vortex 32 to get into that space and add a closing moment that can help the torsion spring close the flapper.

It should also be noted that as the velocity increases the vortex 32 moves closer to the pivot shaft 18 and has a much smaller moment arm in the high pressure zone that it creates. That is one reason that the various inserts of FIGS. 3-5 end at the flapper base 48. Optionally there can be a gap between the insert of any of the illustrated configurations or others that can be developed with mathematical modeling and the flapper base.

Another option to get an assist to the flapper 22' is illustrated in FIG. 3. A passage or passages 70 can start at passage 44 at a location 72 that is above the shoulder 76 where the flow tube 77 lands when the valve is in the open position. When the vortex 32 is centered on the flapper 22', the tubing pressure in the passage 44 can be communicated to the zone behind the flapper 22' at 74. The passage 70 can be run as shown in FIG. 3 or it can use an external jumper if the passage from location 72 is run to the exterior face 79 and then jumpered to the outer face and into a lateral bore of the housing 81 in behind the flapper 22'.

While the illustrated valve is shown as operated with a flow tube 77 other designs using flappers that operate without a flow tube are also contemplated. Such devices can be powered by magnetic or other force fields to move the flapper between the open and closed positions.

The above description is illustrative of the preferred embodiment and various alternatives and is not intended to embody the broadest scope of the invention, which is determined from the claims appended below, and properly given their full scope literally and equivalently.

We claim:

1. A valve for subterranean use in a tubular string, comprising:

a housing with end connections adapted for mounting the housing to the string;

a flapper pivotally mounted in a recess adjacent a passage in said housing, said passage extending between said ends, said flapper mounted on a pivot and biased to move toward a seat that surrounds said passage when said flapper is not selectively retained in said recess by a flow tube, said flapper defining the closed position by contacting said seat;

said recess defined by an enlarged dimension for said passage in said housing and said flapper selectively disposed within said recess when said flapper is retained by said flow tube, said recess extending circumferentially beyond said flapper and an insert mounted at least in part in said recess said insert acting to at least reduce a flow induced vortex in said passage adjacent said flapper created by flow that would otherwise move said flapper toward said seat, said vortex, without said insert, otherwise raising pressure adjacent the flapper to a level that retains said flapper in said recess by overcoming said bias to said closed position when said flapper is not selectively retained in said open position by said flow tube.

2. The valve of claim 1, wherein:

said insert is a shape integrated into a flapper base that is disposed in said recess and pivotally supports said flapper.

3. The valve of claim 1, wherein:

said insert is wider adjacent a flapper base located in said recess than at an opposite end thereof.

4. The valve of claim 1, wherein:

said insert comprises at least one ridge.

5. The valve of claim 4, wherein:

said ridge comprises a plurality of aligned ridges oriented parallel, perpendicular or obliquely to the flow through said passage.

6. The valve of claim 1, wherein:

said insert comprises at least one internal opening.

7. The valve of claim 1, wherein:

said housing comprises a path starting from said passage and extending into said recess to direct pressure against said flapper that urges it toward said closed position.

8. The valve of claim 1, wherein:

said insert is wholly within said recess.

9. The valve of claim 1, wherein:

said insert extends out of said recess and into said passage.

10. The valve of claim 1, wherein:

said insert has a roughened surface that faces said passage.

11. A valve for subterranean use in a tubular string, comprising:

a housing with end connections adapted for mounting the housing to the string;

a flapper pivotally mounted in a recess adjacent a passage in said housing, said passage extending between said ends, said flapper mounted on a pivot and biased to move toward a seat that surrounds said passage when said flapper is not selectively retained in said recess, said flapper defining the closed position by contacting said seat; and an insert mounted at least in part in said recess said insert acting to at least reduce a flow induced vortex in said passage adjacent said flapper, said vortex, without said insert, otherwise raising pressure adjacent the flapper to a level that retains said flapper in said recess by overcoming said bias to said closed position when said flapper is not selectively retained in said open position;

said insert is spaced apart from a flapper base that is disposed in said recess and pivotally supports said flapper.

12. A valve for subterranean use in a tubular string, comprising:

a housing with end connections adapted for mounting the housing to the string;

a flapper pivotally mounted in a recess adjacent a passage in said housing, said passage extending between said ends, said flapper mounted on a pivot and biased to move toward a seat that surrounds said passage when said flapper is not selectively retained in said recess, said flapper defining the closed position by contacting said seat; and an insert mounted at least in part in said recess said insert acting to at least reduce a flow induced vortex in said passage adjacent said flapper, said vortex, without said insert, otherwise raising pressure adjacent the flapper to a level that retains said flapper in said recess by overcoming said bias to said closed position when said flapper is not selectively retained in said open position said insert is wider adjacent a flapper base located in said recess than at an opposite end thereof;

said opposite end of said insert defines a sharp or blunt pointed end with side edges that taper away from each other in the flow direction through said passage with said flapper open.

13. A valve for subterranean use in a tubular string, comprising:

a housing with end connections adapted for mounting the housing to the string;

a flapper pivotally mounted in a recess adjacent a passage in said housing, said passage extending between said ends, said flapper mounted on a pivot and biased to move toward a seat that surrounds said passage when said flapper is not selectively retained in said recess, said flapper defining the closed position by contacting said seat; and an insert mounted at least in part in said recess said insert acting to at least reduce a flow induced vortex in said passage adjacent said flapper, said vortex, without said insert, otherwise raising pressure adjacent the flapper to a level that retains said flapper in said recess by overcoming said bias to said closed position when said flapper is not selectively retained in said open position;

said insert comprises at least one internal opening;

said opening has a quadrilateral shape.

14. A valve for subterranean use in a tubular string, comprising:

a housing with end connections adapted for mounting the housing to the string;

a flapper pivotally mounted in a recess adjacent a passage in said housing, said passage extending between said ends, said flapper mounted on a pivot and biased to move toward a seat that surrounds said passage when said flapper is not selectively retained in said recess, said flapper defining the closed position by contacting said seat; and an insert mounted at least in part in said recess said insert acting to at least reduce a flow induced vortex in said passage adjacent said flapper, said vortex, without said insert, otherwise raising pressure adjacent the flapper to a level that retains said flapper in said recess by overcoming said bias to said closed position when said flapper is not selectively retained in said open position;

said insert is axially aligned with said flapper when said flapper is in said open position and occupies the balance of said recess circumferentially around said flapper when said flapper is in said open position.

15. A valve for subterranean use in a tubular string, comprising:

a housing with end connections adapted for mounting the housing to the string;

a flapper pivotally mounted in a recess adjacent a passage in said housing, said passage extending between said ends, said flapper mounted on a pivot and biased to move toward a seat that surrounds said passage when said flapper is not selectively retained in said recess, said flapper defining the closed position by contacting said seat; and an insert mounted at least in part in said recess said insert acting to at least reduce a flow induced vortex in said passage adjacent said flapper, said vortex, without said insert, otherwise raising pressure adjacent the flapper to a level that retains said flapper in said recess by overcoming said bias to said closed position when said flapper is not selectively retained in said open position;

said flapper has at least one groove in its surface facing into said recess.

16. A valve for subterranean use in a tubular string, comprising:

a housing with end connections adapted for mounting the housing to the string;

a flapper pivotally mounted in a recess adjacent a passage in said housing, said passage extending between said ends, said flapper mounted on a pivot and biased to move toward a seat that surrounds said passage when said flapper is not selectively retained in said recess, said flapper defining the closed position by contacting said seat; and an insert mounted at least in part in said recess said insert acting to at least reduce a flow induced vortex in said passage adjacent said flapper, said vortex, without said insert, otherwise raising pressure adjacent the flapper to a level that retains said flapper in said recess by overcoming said bias to said closed position when said flapper is not selectively retained in said open position;

said insert extends circumferentially in said recess for at least 180 degrees.

17. A valve for subterranean use in a tubular string, comprising:

a housing with end connections adapted for mounting the housing to the string;

a flapper pivotally mounted in a recess adjacent a passage in said housing, said passage extending between said ends, said flapper mounted on a pivot and biased to move toward a seat that surrounds said passage when said flapper is not selectively retained in said recess, said flapper defining the closed position by contacting said seat; and an insert mounted at least in part in said recess said insert acting to at least reduce a flow induced vortex in said passage adjacent said flapper, said vortex, without said insert, otherwise raising pressure adjacent the flapper to a level that retains said flapper in said recess by overcoming said bias to said closed position when said flapper is not selectively retained in said open position;

said housing comprises a path starting from said passage and extending into said recess to direct pressure against said flapper that urges it toward said closed position;

said flapper is selectively retained in said open position by a flow tube that covers an inlet to said path and uncovers said inlet on initial movement of said flow tube away from said flapper.

* * * * *